US007543863B2

(12) United States Patent
Herbert et al.

(10) Patent No.: US 7,543,863 B2
(45) Date of Patent: Jun. 9, 2009

(54) LOW PROFILE DOOR HANDLE ASSEMBLY

(75) Inventors: Russell S. Herbert, Macomb Township, MI (US); Garvin Gentry, Sterling Heights, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 601 days.

(21) Appl. No.: 11/230,440

(22) Filed: Sep. 20, 2005

(65) Prior Publication Data

US 2007/0069531 A1 Mar. 29, 2007

(51) Int. Cl.
*E05B 3/00* (2006.01)

(52) U.S. Cl. ..... 292/336.3; 292/DIG. 20; 292/DIG. 31

(58) Field of Classification Search ..... 292/336.3, 292/DIG. 20, DIG. 31
See application file for complete search history.

(56) References Cited

U.S. PATENT DOCUMENTS

| | | | | |
|---|---|---|---|---|
| 3,153,553 | A * | 10/1964 | Sandor | 292/336.3 |
| 3,528,695 | A * | 9/1970 | Peters | 292/336.3 |
| 6,698,262 | B2 * | 3/2004 | Wittwer | 70/208 |
| 2005/0121924 | A1 | 6/2005 | Chanya | |

* cited by examiner

*Primary Examiner*—Gary Estremsky

(57) ABSTRACT

A door handle assembly is provided for a door of a vehicle. The door handle assembly includes a mount adapted for attachment to the vehicle, an input member supported for movement relative to the mount, and a handle supported for movement relative to the mount. The handle can move from a low profile position to an extended position. The handle is adjacent the mount in the low profile position, and the handle is spaced from the mount in the extended position. The handle moves from the low profile position to the extended position due to an input provided to the input member. The handle can be further moved from the extended position to an operative position to unlatch the door of the vehicle.

15 Claims, 4 Drawing Sheets

FIG 4
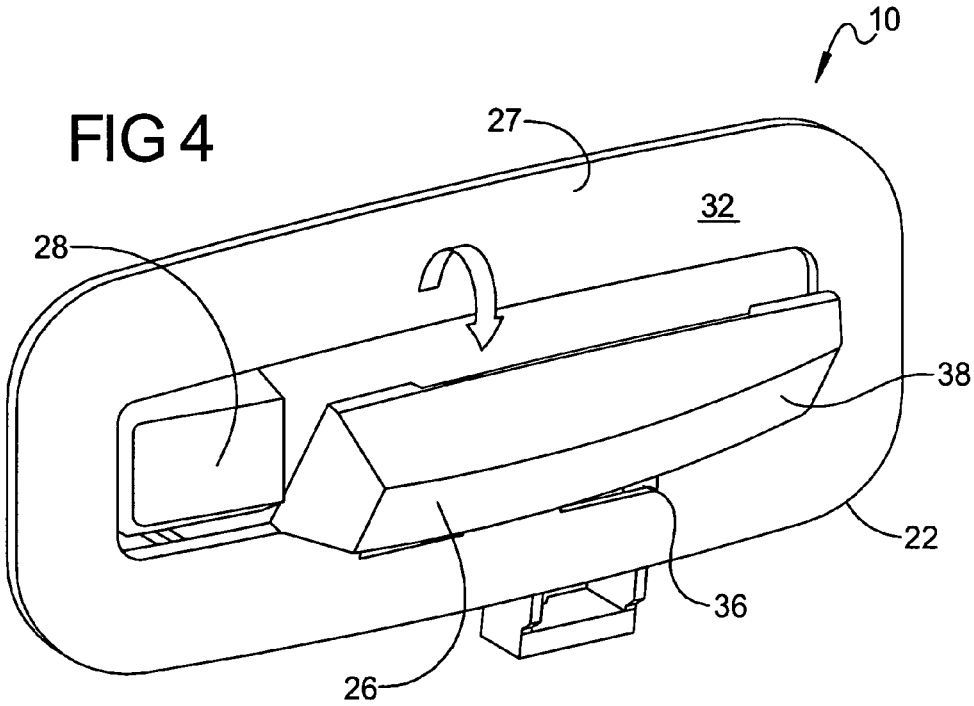
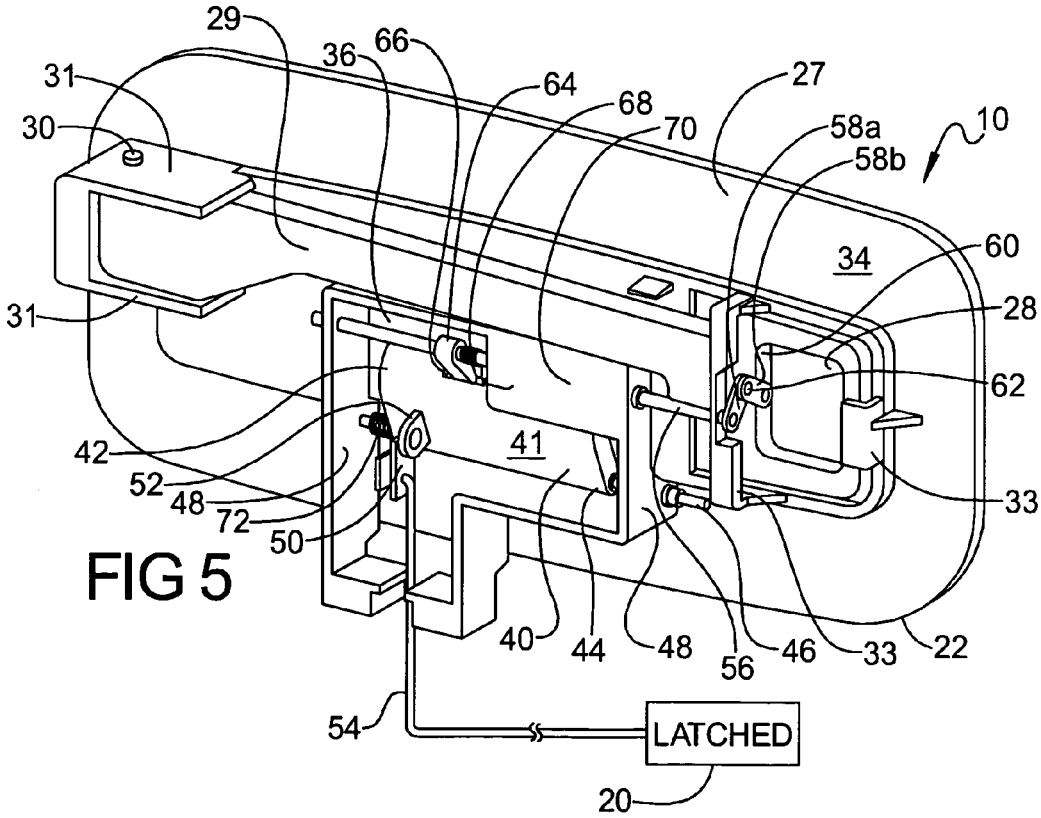
FIG 5

LOW PROFILE DOOR HANDLE ASSEMBLY

TECHNICAL FIELD

The present invention relates generally to door handles and, more particularly, to a low profile door handle assembly for a vehicle.

BACKGROUND OF THE INVENTION

It is known to provide a door handle assembly for unlatching and opening a door of a vehicle. Many vehicle doors typically include a door handle and a latch mechanism, and the door handle is moved relative to a body of the vehicle to actuate the latch mechanism so that the door of the vehicle can be opened.

However, door handles are typically offset from a surface of the body of the vehicle. This can detrimentally affect the aerodynamics of the vehicle, increase wind noise and/or make the vehicle less aesthetically pleasing. Also, some door handle assemblies can be bulky. These door handle assemblies can be difficult to incorporate into the vehicle because they may interfere with other components, such as window glass and the like. These bulky door handles may also necessitate increasing the size of the doors of the vehicle.

Thus, it is desirable to provide a new door handle assembly for a vehicle that can be positioned in a low profile position, improving the aerodynamics of the vehicle. It is also desirable to provide a new door handle assembly for a vehicle that reduces wind noise and improves the aesthetic appeal of the vehicle. It is further desirable to provide a new door handle assembly for a vehicle that is more compact.

SUMMARY OF THE INVENTION

Accordingly, the present invention is a door handle assembly for a door of a vehicle. The door handle assembly includes a mount adapted for attachment to the door, an input member supported for movement relative to the mount, and a handle supported for movement relative to the mount. The handle can move from a low profile position to an extended position. The handle is adjacent the mount in the low profile position, and the handle is spaced from the mount in the extended position. The handle moves from the low profile position to the extended position due to an input provided to the input member. The handle can be further moved from the extended position to an operative position to unlatch and move the door of the vehicle.

One advantage of the present invention is that a new door handle assembly is provided for a vehicle with a door handle that can be positioned in a low profile position to thereby improve aerodynamics of the vehicle. Another advantage of the present invention is that the door handle assembly reduces wind noise and improves aesthetics of the vehicle. Yet another advantage of the present invention is that the door handle assembly incorporates a door handle that conveniently moves automatically into the extended position by providing input to an input member. Still another advantage of the present invention is that the door handle assembly incorporates a door handle that conveniently moves automatically back into the low profile position once the door handle unlatches a latch assembly. A further advantage of the present invention is that the door handle assembly is relatively compact, thereby allowing the door handle assembly to be more easily incorporated into a body of the vehicle and allowing for the size of the door to be reduced.

Other features and advantages of the present invention will be readily appreciated, as the same becomes better understood, after reading the subsequent description taken in conjunction with the accompanying drawings.

BRIEF DESCRIPTION OF THE DRAWINGS

FIG. 4 is an external perspective view of the door handle assembly of FIG. 1 illustrated in an extended position.

FIG. 5 is an internal perspective view of the door handle assembly of FIG. 1 illustrated in the extended position.

DESCRIPTION OF THE PREFERRED EMBODIMENT

Figure 1:
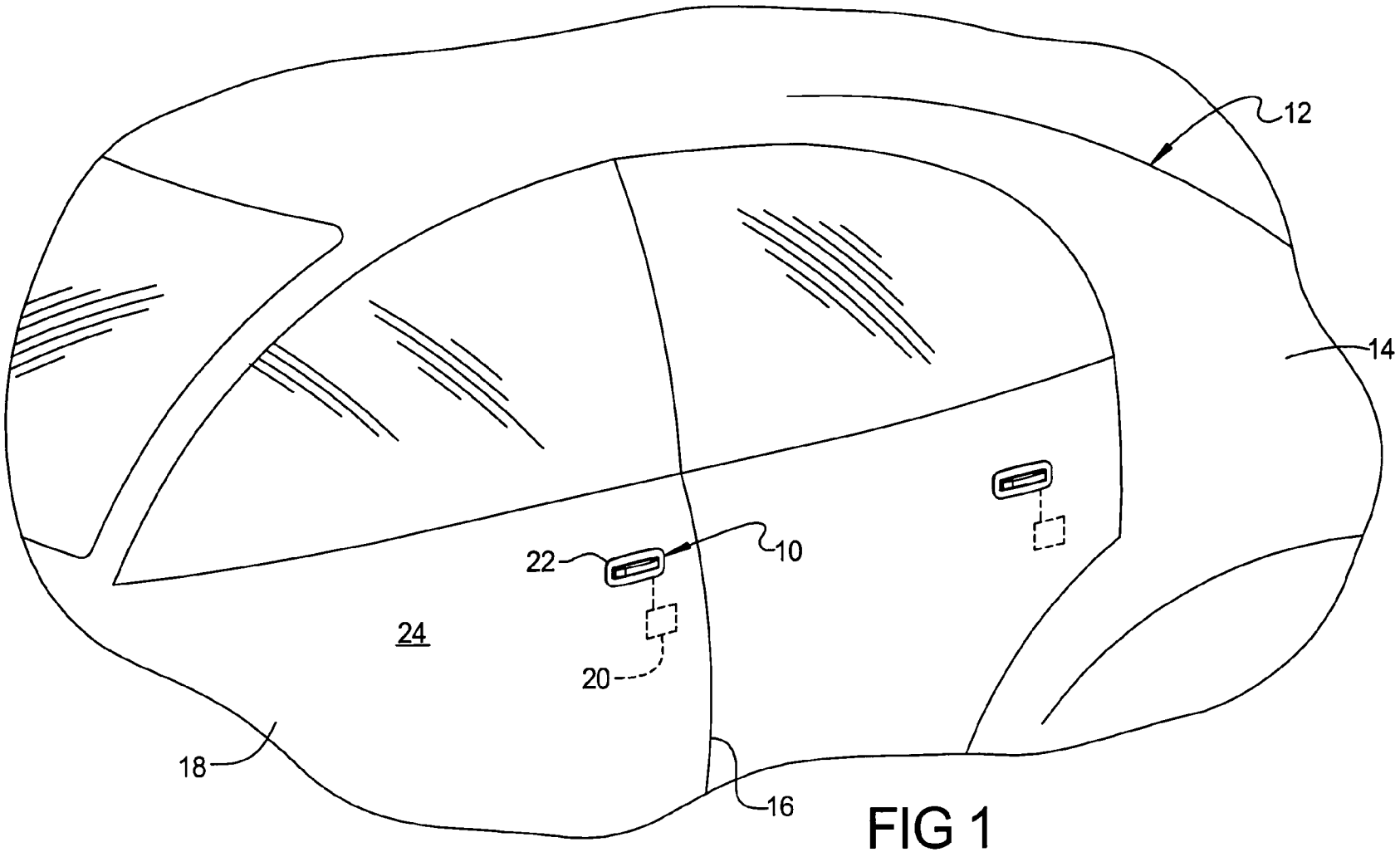
FIG. 1 is a perspective view of a door handle assembly, according to the present invention, illustrated in operational relationship with a vehicle.
Figure 2:
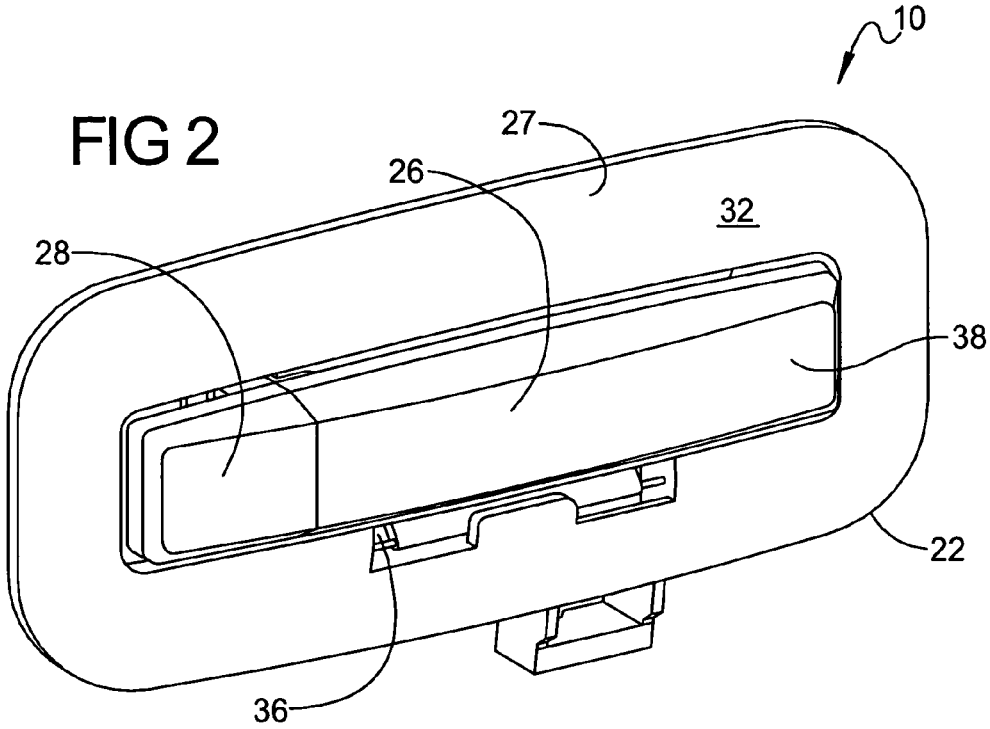
FIG. 2 is an external perspective view of the door handle assembly of FIG. 1 illustrated in a low profile position.

Referring to the drawings and in particular FIG. 1, one embodiment of a door handle assembly 10, according to the present invention, is shown for a vehicle, partially shown and generally indicated at 12. The vehicle 12 includes a body 14 having an opening 16 and a door 18 mounted on the vehicle body 14 for movement between a closed position and an open position relative to the body 14 of the vehicle 12. In the closed position, the door 18 closes or covers the opening 16. In the open position, the door 18 is spaced from the opening 16 to allow passage into and out of an occupant compartment of the vehicle 12. The vehicle 12 also includes a latch assembly, shown schematically at 20, attached to the body 14. The latch assembly 20 is configurable in a latched and an unlatched configuration. In the latched configuration, the latch assembly 20 retains the door 18 in the closed position. In the unlatched configuration, the latch assembly 20 allows the door 18 to be moved from the closed position to the open position. The door handle assembly 10 cooperates with the latch assembly 20 to change latch assembly 20 from the latched configuration to the unlatched configuration. Although the door handle assembly 10 is illustrated on an exterior of the vehicle 12, it should be appreciated that the handle assembly 10 may be disposed on the interior of the vehicle 12. It should also be appreciated that the door 18 may be of any suitable type, such as a side door a back gate of the vehicle 12. It should also be appreciated that, except for the door handle assembly 10, the vehicle 12 is conventional and known in the art.

Figure 3:
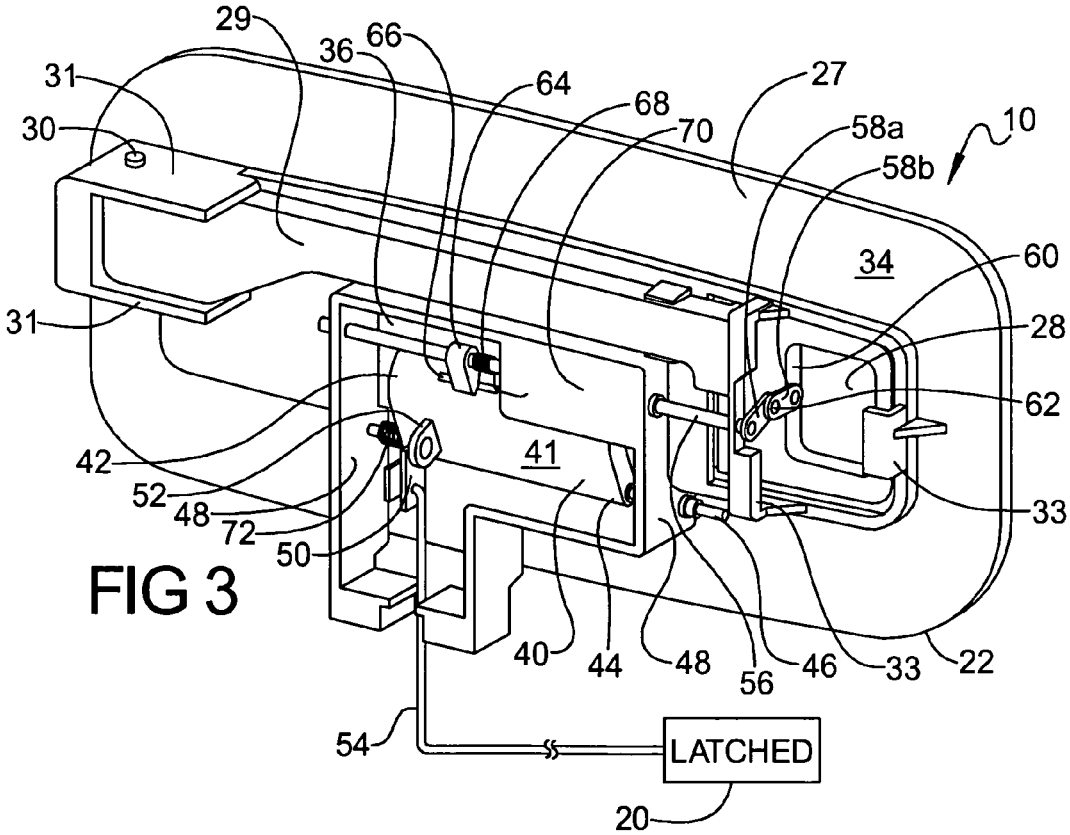
FIG. 3 is an internal perspective view of the door handle assembly of FIG. 1 illustrated in the low profile position.
Figure 6:
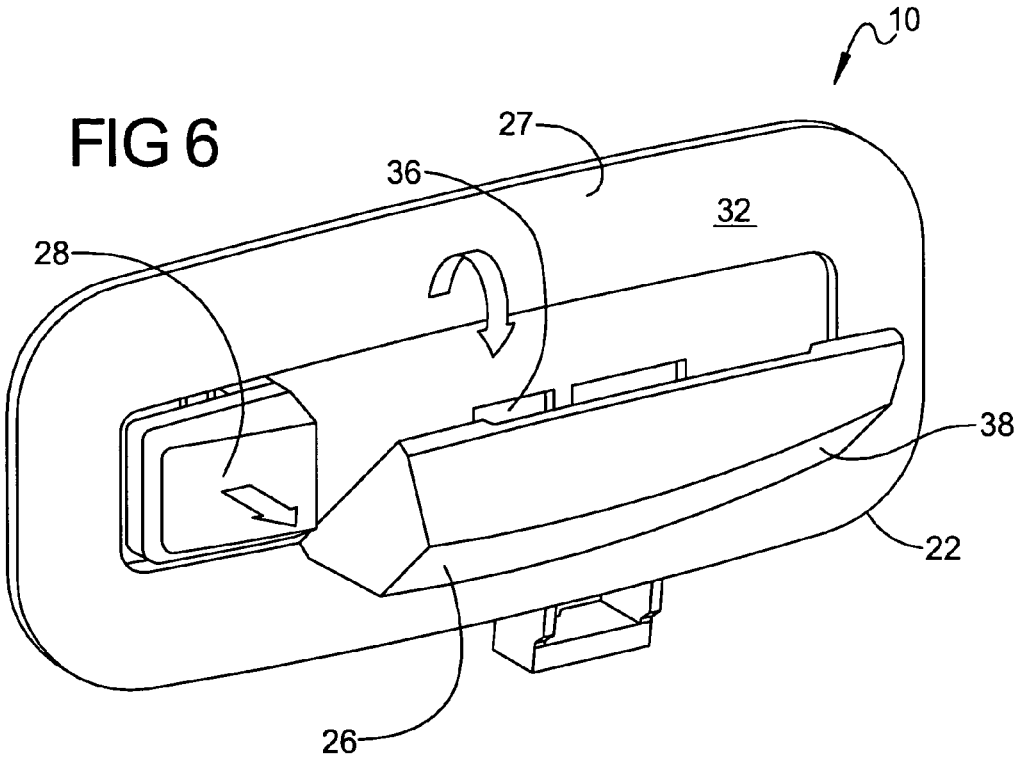
FIG. 6 is an external perspective of the door handle assembly of FIG. 1 illustrated in an operative position.
Figure 7:
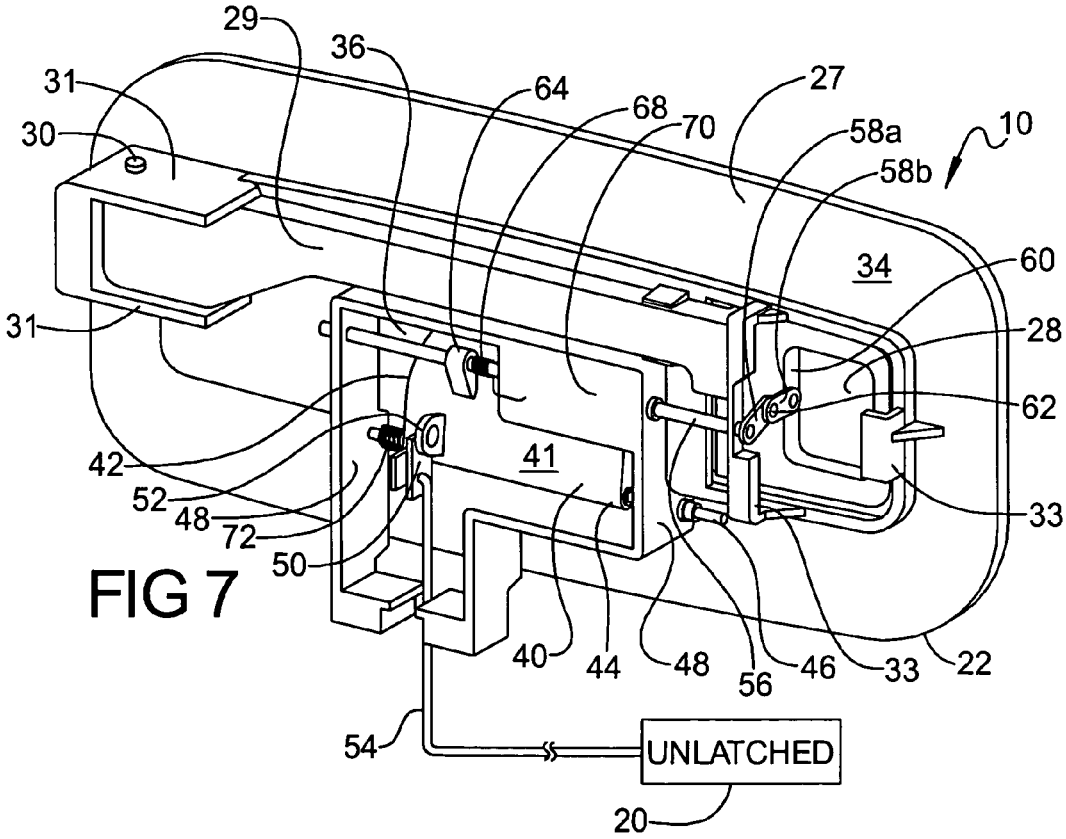
FIG. 7 is an internal perspective view of the door handle assembly of FIG. 1 illustrated in the operative position.

Referring to FIGS. 2 through 7, the door handle assembly 10 includes a mount 22 that is supported by an outer door panel 24 of the door 18 (FIG. 1). The mount 22 defines an outer surface 32 (FIGS. 2, 4, 6) and an inner surface 34 (FIGS. 3, 5, 7). The mount 22 also includes an aperture 36. It should be appreciated that the mount 22 may be fixed to the outer door panel 24 by any suitable mechanism such as welding (not shown), and the mount 22 may be integral to the outer door panel 24 or any surrounding structure of the door 18.

The door handle assembly 10 also includes a handle 26. The handle 26 is supported for movement relative to the mount 22 between a low profile position (FIGS. 2 and 3), an extended position (FIGS. 4 and 5), and an operative position (FIGS. 6 and 7). The handle 26 extends through the aperture 36 of the mount 22. In the low profile position, the handle 26 is adjacent and substantially flush with the mount 22 to thereby improve vehicle aerodynamics, reduce wind noise, and improve vehicle aesthetics. In the extended position, the handle 26 is spaced from the mount 22 to allow a user to manipulate the handle 26. In the operative position, the handle 26 is further spaced from the mount 22, and when the handle 26 is in the operative position, the door handle assembly 10 unlatches the latch assembly 20.

In one embodiment, the handle 26 pivots away from the mount 22 when moving to at least one of the extended position and the operative position. In the embodiment illustrated, the handle 26 pivots away from a top side 27 of the mount 22 when moving from the low profile position to the extended position, and the handle 26 pivots further away from the top side 27 when moving from the extended position toward the operative position. It should be appreciated that the handle 26 could pivot in any suitable manner away from the mount 22.

The door handle assembly 10 further includes an input member 28, such as a button. The input member 28 extends though the aperture 36 of the mount 22 and is disposed adjacent the handle 26. The input member 28 is also moveably supported relative to the mount 22 between a first position (FIGS. 2 and 3) and an operative position (FIGS. 4 and 5). The door handle assembly 10 also includes an arm 29 (FIGS. 3, 5, and 7). The arm 29 is operatively attached at one end to the input member 28. The opposite end of the arm 29 is pivotally attached with a pin 30 to walls 31 extending from the inner surface 34 of the mount 22. The input member 28 pivots about the axis of the pin 30 when moving between the first position and the operative position. The mount 22 also includes a plurality of stops 33 extending from the inner surface 34 of the mount 22 to limit the movement of the input member 28. It should be appreciated that, when the input member 28 moves from the first position toward the operative position, the input member 28 eventually abuts against the stops 33 for limiting movement in the operative position.

Input provided to the input member 28 causes the handle 26 to be moved from the low profile position (FIGS. 2 and 3) to the extended position (FIGS. 4 and 5). For example, assuming the handle 26 is in the low profile position, the user can move the input member 28 with their hand from the first position to the operative position by pressing the input member 28 to thereby cause the handle 26 to automatically pivot downward from the top side 27 of the mount 22 to the extended position. Then, the user can grab the handle 26 and pivotally move the handle 26 further from the top side 27 to the operative position. The latch assembly 20 remains in the latched configuration when the handle 26 moves from the low profile position to the extended position, but the latch assembly 20 unlatches when the handle 26 moves from the extended position to the operative position, thereby allowing the door 18 to be opened. It should be appreciated that the handle 26 can move in any suitable manner when moving to any of the low profile, extended, and operative positions. It should also be appreciated that the input member 28 could be of any suitable type, such as a remote control.

In the embodiment illustrated, the handle 26 includes a front portion 38 (FIGS. 2, 4, 6) and rear portion 40 (FIGS. 3, 5, 7). The front portion 38 is generally elongate. The rear portion 40 includes an outer surface 41 with a contoured upper end 42 and a flat lower end 44. The front portion 38 and rear portion 40 of the handle 26 are fixed together so as to move as a unit. In one embodiment, the front portion 38 is integral to the rear portion 40. In another embodiment, the front portion 38 is separate, but attached to the rear portion 40.

Referring to FIGS. 3, 5, and 7, the door handle assembly 10 also includes a lower pivot rod 46. The lower pivot rod 46 is axially straight and extends through the rear portion 40 of the handle 26. In one embodiment, the lower pivot rod 46 extends through the lower end 44 of the handle 26. The lower pivot rod 46 is also pivotally attached at both ends to respective walls 48 extending from the inner surface 34 of the mount 22. It should be appreciated that the handle 26 pivots about the axis of the lower pivot rod 46 when moving between the low profile position, the extended position, and the operative position.

The door handle assembly 10 includes a clip 50. The clip 50 is pivotally attached to a tab 52 fixed to the lower end 44 of the handle 26. The clip 50 is operatively attached to the latch assembly 20 such that movement of the clip 50 unlatches the latch assembly 20. In the embodiment illustrated, the latch assembly 20 includes a cable 54, and the cable 54 is operatively attached to the clip 50. As the handle 26 rotates about the axis of the lower pivot rod 46, the tab 52 pulls upward on the clip 50, to thereby pull the cable 54 and unlatch the latch assembly 20.

The door handle assembly 10 further includes an upper pivot rod 56. The upper pivot rod 56 is linear axially and is pivotally mounted at each end to one of the walls 48.

The door handle assembly 10 includes a plurality of linkages 58*a*, 58*b* that operatively interconnect the input member 28 to the upper pivot rod 56. A first linkage 58*a* is fixed to one end of the upper pivot rod 56 and extends perpendicularly from the axis of the upper pivot rod 56. A second linkage 58*b* is operatively attached to a rear surface 60 of the input member 28. The first and second linkages 58*a* and 58*b* are pivotally attached with a pin 62. It should be appreciated that, when the input member 28 is moved from the first position to the operative position, the second linkage 58*b* rotates the first linkage 58*a* to thereby rotate the upper pivot rod 56.

The door handle assembly 10 also includes a cam member 64. The cam member 64 is fixed to the upper pivot rod 56 and extends perpendicularly from the axis of the upper pivot rod 56. The rotation of the upper pivot rod 56 also rotates the cam member 64. When the input member 28 is moved from the first position to the operative position, the linkages 58*a*, 58*b* rotate the upper pivot rod 56, which, in turn, rotates the cam member 64 toward the rear portion 40 of the handle 26. The cam member 64 cams the outer surface 41 of rear portion 40 of the handle 26. As such, the cam member 64 moves the handle 26 from the low profile position to the extended position when the input member 28 is pressed.

The door handle assembly 10 further includes a notch 66 formed in the upper end 42 of the rear portion 40 of the handle 26. When the input member 28 is pressed, the upper pivot rod 56 rotates the cam member 64 to cam the handle 26, and cam member 64 eventually lodges in the notch 66. It should be appreciated that the cam member 64 retains the handle 26 in the extended position when lodged in the notch 66 as illustrated in FIGS. 4 and 5.

The door handle assembly 10 also includes a first biasing member 68. In the embodiment illustrated, the first biasing member 68 is a torsion spring at least partially wrapped around the upper pivot rod 56. One end of the first biasing member 68 abuts the cam member 64. The opposite end of the first biasing member 68 abuts an abutment wall 70 of the mount 22. When the user rotates the handle 26 from the extended position to the operative position, the cam member 64 dislodges from the notch 66, and the first biasing member 68 biases the cam member 64 away from the handle 26. As the cam member 64 moves away from the handle 26, the upper pivot rod 56 rotates, thereby actuating the linkages 58*a* and 58*b* and returning the input member 28 to an extended position. It should be appreciated that the first biasing member 68 biases the input member 28 away from the operative position and toward the first position. It should also be appreciated that once the cam member 64 dislodges from the notch 66, the handle 26 is free to return to the low profile position.

The door handle assembly 10 further includes a second biasing member 72 that biases the handle 26 toward the low profile position. In the embodiment illustrated, the second biasing member 72 is a torsion spring at least partially wound around the lower pivot rod 46. One end of the second biasing member 72 is mounted to the handle 26, and the other end of the second biasing member 72 is mounted to one of the walls 48. It should be appreciated that, once the user moves the handle 26 from the extended position to the operative position and the cam member 64 dislodges from the notch 66, the second biasing member 72 automatically returns the handle 26 to the low profile position.

In operation of the door handle assembly 10, when a user desires to open the door 18 of the vehicle 12, the user presses the input member 28 and moves it from the first position (FIGS. 2 and 3) to the operative position (FIGS. 4 and 5). Movement of the input member 28 rotates the cam member 64 toward the rear portion 40 of the handle 26 to cam the outer surface 41 such that the handle 26 pivots about the axis of the lower pivot rod 46 from the low profile position toward the extended position. The cam member 64 eventually lodges in the notch 66 to thereby retain the handle 26 in the extended position, thereby allowing the user to grab the front portion 38 of the handle 26 and pivot the handle 26 further away from the mount 22 about the lower pivot rod 46 from the extended position toward the operative position. This movement of the handle 26 causes upward movement of the clip 50 to thereby pull the cable 54 and unlatch the latch assembly 20. Then, the door 18 of the vehicle 12 can be opened. Movement of the handle 26 from the extended position toward the operative position also dislodges the cam member 64 from the notch 66. The first biasing member 68 moves the cam member 64 away from the handle 26 and notch 66, and the first biasing member 68 also causes movement of the input member 28 from the operative position toward the first position. When the user releases the handle 26 from the operative position, the second biasing member 72 automatically moves the handle 26 back to the low profile position.

Thus, the door handle 26 can be positioned in the low profile position to thereby improve aerodynamics of the vehicle 12, to reduce wind noise, and to improve aesthetics of the vehicle 12. The door handle 26 conveniently moves automatically into the extended position by providing input to the input member 28. Also, the door handle 26 conveniently moves automatically back into the low profile position once the door handle assembly 10 unlatches the latch assembly 20. Further, the door handle assembly 10 is relatively compact, thereby allowing the door handle assembly 10 to be more easily incorporated in the vehicle 12 and allowing the size of the door 18 to be reduced.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A door handle assembly for unlatching a door of a vehicle, said door handle assembly comprising:

a mount adapted for attachment to the door of the vehicle;

an input member supported for movement relative to said mount;

a handle supported for movement relative to said mount from a low profile position, wherein said handle is adjacent said mount, to an extended position, wherein said handle is spaced from said mount, due to an input provided to said input member, and wherein said handle can be further moved from the extended position to an operative position to unlatch the door of the vehicle, said handle including a notch;

a cam member, wherein an input provided to said input member causes said cam member to cam said handle from the low profile position to the extended position, and wherein said input provided to said input member causes said cam member to lodge in said notch, thereby retaining said handle in the extended position; and a pivot rod to dislodge said cam member from said notch when said handle is moved from the extended position to the operative position such that said handle is free to return to the low profile position.

2. A door handle assembly as set forth in claim 1 including a pivot mechanism to allow said handle to pivot away from said mount when moving to at least one of the extended position and the operative position.

3. A door handle assembly as set forth in claim 2 wherein said mount defines a top side and wherein said handle pivots away from said top side of said mount when moving to at least one of the extended position and the operative position.

4. A door handle assembly as set forth in claim 1 including a biasing member to urge said handle toward the low profile position such that said handle automatically returns to the low profile position when the cam member dislodges from said notch.

5. A door handle assembly as set forth in claim 1 wherein said input member is a button supported for movement relative to said mount, and wherein movement of said button from a first position to an operative position causes movement of said handle from the low profile position to the extended position.

6. A door handle assembly as set forth in claim 5 including a biasing member to urge said button away from the operative position and toward the first position.

7. A door assembly for a vehicle comprising:

a door;

a latch assembly attached to a body of the vehicle and configurable in a latched configuration and an unlatched configuration to latch and unlatch said door;

an input member supported for movement relative to said door;

a handle supported for movement relative to said door from a low profile position, wherein said handle is adjacent said door, to an extended position, wherein said handle is spaced from said door, due to an input provided to said input member, and wherein said handle can be further moved from the extended position to an operative position to thereby change the configuration of the latch assembly from the latched configuration to the unlatched configuration, said handle including a notch;

a cam member, wherein an input provided to said input member causes said cam member to cam said handle from the low profile position to the extended position, and wherein said input provided to said input member causes said cam member to lodge in said notch, thereby retaining said handle in the extended position; and a pivot rod to dislodge said cam member from said notch when said handle is moved from the extended position to the operative position such that said handle is free to return to the low profile position.

8. A door assembly as set forth in claim 7 including a pivot mechanism to pivot said handle away from said door when moving to at least one of the extended position and the operative position.

9. A door assembly as set forth in claim 8 wherein said door has a top side and wherein said handle pivots away from said top side of said door when moving to at least one of the extended position and the operative position.

10. A door assembly as set forth in claim 7 including a biasing member to urge said handle toward the low profile position such that said handle automatically returns to the low profile position when said cam member dislodges from said notch.

11. A door assembly as set forth in claim 7 wherein said input member is a button supported for movement relative to said door panel, and wherein movement of said button from a first position to an operative position causes movement of said handle from the low profile position to the extended position.

12. A door assembly as set forth in claim 11 including a biasing member to urge said button away from the operative position and toward the first position.

13. A door handle assembly for unlatching a door of a vehicle, said door handle assembly comprising:

a mount adapted for attachment to the door of the vehicle;

an input member including a button supported for movement relative to said mount and configured to be exposed outside of the door for user actuation;

a handle supported for movement relative to said mount, independent of the movement of said input member, from a low profile position, wherein said handle is adjacent said mount, to an extended position, wherein said handle is spaced from said mount, due to an input provided to said input member, and wherein said handle can be further moved from the extended position to an operative position to unlatch the door of the vehicle, said handle including a notch; and a cam member, wherein an input provided to said input member causes said cam member to cam said handle from the low profile position to the extended position, and wherein said input provided to said input member causes said cam member to lodge in said notch, thereby retaining said handle in the extended position.

14. The door handle assembly as set forth in claim 13 including a biasing member to urge said handle toward the low profile position such that said handle automatically returns to the low profile position when the cam member dislodges from said notch.

15. The door handle assembly as set forth in claim 13 wherein movement of said button from a first position to an operative position causes movement of said handle from the low profile position to the extended position, and the input member includes a biasing member to urge said button away from the operative position and toward the first position.

* * * * *